United States Patent [19]

Scherrer et al.

[11] Patent Number: 4,542,816

[45] Date of Patent: Sep. 24, 1985

[54] EXIT CLIP FOR INSERTION OF THE WEFT IN THE SHED OF A SHUTTLELESS WEAVING LOOM

[75] Inventors: Pascal Scherrer; Yves Juillard, both of Mulhouse, France

[73] Assignee: Societe Alsacienne de Constructions Mechaniques de Mulhouse, Mulhouse Cedex, France

[21] Appl. No.: 400,125

[22] Filed: Jul. 20, 1982

[30] Foreign Application Priority Data

Jul. 28, 1981 [FR] France ..... 81 14602

[51] Int. Cl.[4] ..... D03D 47/18

[52] U.S. Cl. ..... 139/448

[58] Field of Search ..... 139/447, 448

[56] References Cited

U.S. PATENT DOCUMENTS

| | | | |
|---|---|---|---|
| 3,978,897 | 9/1976 | Tosches | 139/448 |
| 4,062,382 | 12/1977 | Rohr et al. | 139/448 |
| 4,226,265 | 10/1980 | Zollinger | 139/448 |
| 4,418,727 | 12/1983 | Santucci | 139/448 |

*Primary Examiner*—Henry S. Jaudon

*Attorney, Agent, or Firm*—Yuter, Rosen & Dainow

[57] ABSTRACT

In a shuttleless loom in which the weft thread is inserted by an entry needle, the yarn is transferred at the center of the width of cloth to an exit needle which carries an exit clip. The stationary clip body has a wedge-shaped end which cooperates with a hook carried by a movable portion for clamping the weft thread. The yarn is held between two clamping facets carried by the wedge-shaped end of the clip body and by the hook, the facets being inclined with respect to the plane of displacement of the movable portion.

5 Claims, 5 Drawing Figures

EXIT CLIP FOR INSERTION OF THE WEFT IN THE SHED OF A SHUTTLELESS WEAVING LOOM

This invention relates to the textile industry and more particularly to the field of shuttleless weaving looms.

A well-known means for inserting weft in the shed of a weaving loom of this type consists in making use of a pair of rigid or flexible needles which are driven in reciprocating motion in opposite directions between the selvedges and a point usually corresponding to the center of the cloth which is being woven. Each needle is adapted to carry a clip. The clip which is attached to the so-called entry or feed needle is intended to grip the end of the filling yarn to be inserted in the vicinity of one of the selvedges and introduces it into the shed. At a point near the center of the cloth, the entry-needle clip transfers the filling yarn to the clip which is attached to the other needle designated as the exit or drawing needle which withdraws together with the yarn to the other selvedge.

The invention is more specifically concerned with an improvement to the so-called exit clip which is attached to the end of the exit needle.

This mode of insertion is becoming more and more difficult to apply in practice as weaving looms are designed to operate at increasingly high speeds. In fact, the entry needle takes the filling yarn when this latter is subjected to a considerable acceleration and is thus liable to cause breakage of the yarn, especially if it is fine or delicate. The time allowed for the exchange of filling yarn between the entry needle and the exit needle is of increasingly short duration, with the result that said exchange must therefore take place at a high speed while remaining accurate.

All these considerations point to the need for increasingly lightweight clips which are capable of gripping and releasing the yarn with precision and of traveling within sheds which close at constantly higher speeds.

Patent No. DE-20 61 194 describes an exit clip of an improved type in comparison with the designs which had existed in the prior art. In this patent, the yarn is clamped between a hook-shaped stationary portion which is rigidly fixed to the clip body and a movable central member which has a controllable opening and the end of which is adapted to engage within the hook opening in order to retain the yarn therein. However, the yarn is clamped between two substantially vertical and parallel facets. This produces a double wedge effect, with the result that the yarn has a locking action on the clip. In order to release the clip at the exit of the cloth, it is opened by pressing on the central member in order to cause the clip to move away from the hook, but if the clip body which carries the hook has insufficient rigidity, said body follows the movable portion and the clip fails to open. In order to guard against such a fault condition, provision has to be made for a massive clip which is consequently of substantial weight.

The object of the present invention is to overcome these drawbacks by providing a lightweight exit clip which releases the yarn in a rapid and reliable manner. Jamming of the clip by the yarn is prevented by clamping this latter between facets which are inclined with respect to the plane of displacement of the hook. The hook is no longer carried by the clip body but by the movable portion, thus taking advantage of the pressure of the yarn on the hook in order to increase the force which initiates the closing action of this latter.

The invention consists of an exit clip for insertion of the weft in a shuttleless weaving loom in which the yarn is clamped between a stationary portion and a movable portion, one of said portions being designed in the shape of a hook. The distinctive feature of the invention lies in the fact that the hook is carried by the movable portion and the two facets between which the yarn is clamped are inclined at a predetermined angle with respect to the plane of displacement of the movable portion.

These and other features of the invention will be more apparent to those skilled in the art upon consideration of the following description and accompanying drawings, wherein.

DESCRIPTION OF THE PREFERRED EMBODIMENT

The clip which forms the subject of the present invention is made up of two generally elongated parts, namely a stationary part or body 1 which is rigidly fixed to the needle 2 and a movable part 3. These two parts are rotationally coupled by means of a pivot-pin 4 which passes through the body 1 and is riveted at 5 in order to retain the movable part 3.

Figure 3:
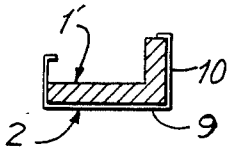
FIG. 3 is a section view taken along line 3—3 of FIG. 2 showing the clip-carrier needle.

The body 1 is composed of a portion 1' (see also FIG. 3) in the form of a right angle which fits closely within the internal walls 9 and 10 of the needle 2 and is secured to said needle by means of screws 11 and 11' but any other known systems such as bonding, riveting and so on may be employed. A blade spring 12, the function of which will be explained in greater detail below, is attached to the body 1 by means of screws 13.

The body 1 terminates in an active yarn-clamping portion 15 adapted to cooperate with a hook 14 formed at the corresponding end portion of the movable part 3.

During operation, the clip travels alternately in the directions 6—6' between the reed P and the fell F of the cloth T which is being formed. The warp threads 7—7' are also shown in FIG. 1.

Figure 1:
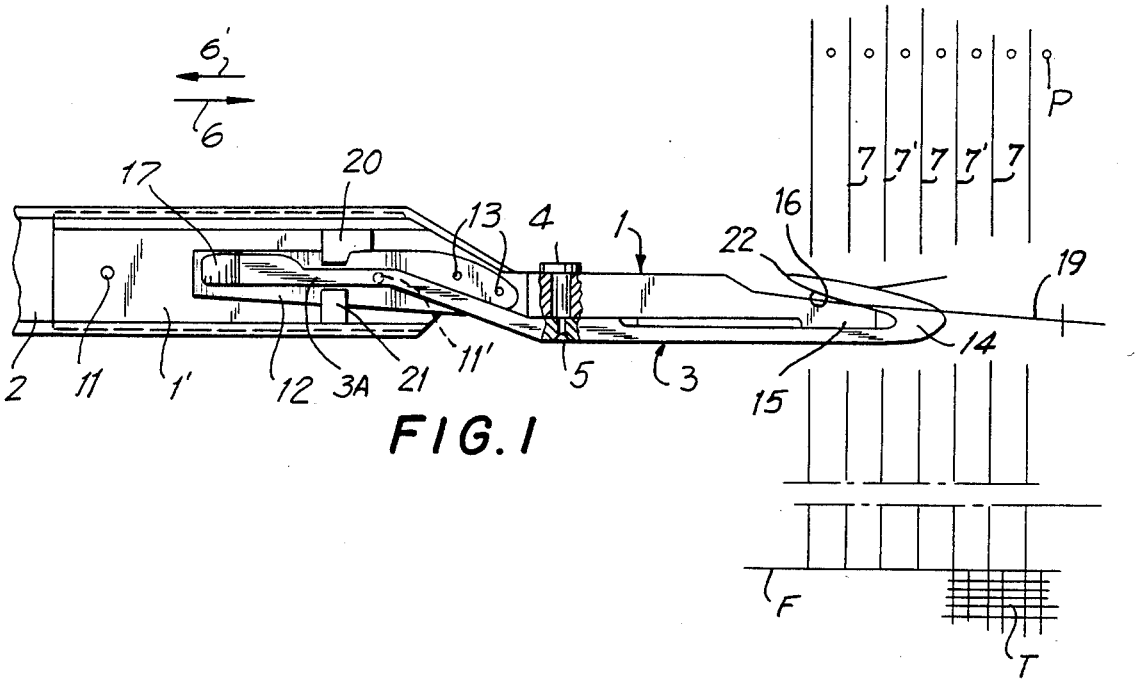
FIG. 1 is a top view showing a clip in accordance with the invention.
Figure 5:
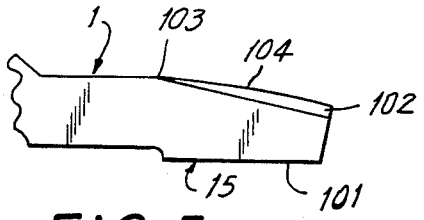
FIG. 5 is, also on a larger scale, a detail view showing the active end portion of the body of the clip.
Figure 4:
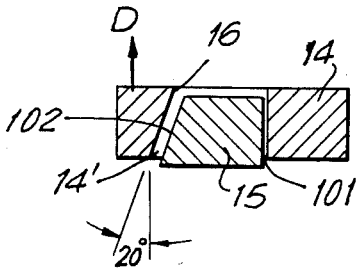
FIG. 4 is, on a larger scale, a sectional view taken along line 4—4 of FIG. 2 and showing a clip in the clamping zone.

The active portion 15 of the movable part (shown in FIG. 5) has a first longitudinal edge 101 (see also FIGS. 4 and 5) facing the fell F of the cloth and a second longitudinal edge 102 which is located on the side opposite to the first longitudinal edge and constitutes a facet for clamping the yarn 19 (FIG. 1). Said clamping facet is adapted to cooperate with a corresponding opposite facet 16 formed in the hook 14 and has two angles of slope, namely a first angle of slope with respect to the longitudinal direction of the clip, which provides the end portion 15 of the stationary part with a wedge-shaped configuration, and a second angle of slope with respect to the plane of displacement of the movable part. In the embodiment herein described, the value of said second angle of slope is approximately 20° (as shown in FIG. 4). This value is defined as being substantially equal to or greater than the limiting gangular value which permits irreversibility of the grip created by the active yarn-clamping portion 15 of the body 1 and the hook 14 on the yarn 19 jammed together within the space 14' provided between the two facets 102 and 16 of the body and hook, respectively. The value of this angle is dependent on the coeffient of friction of the contacting surfaces or, in other words, on the nature of the material constituting the stationary and movable parts of the clip and also on the nature of the yarn. Release of the yarn is discussed below. The junction between the inclined facet 102 and the main portion of the body 1 is provided by a curved zone 104 which forms with a corresponding curve of the hook 14 an opening for insertion of the yarn 19. In order to facilitate insertion of the thickest yarns, the angle of slope of the curved zone 104 may be greater than that of the clamping facet 102.

The end of the movable part 3 remote from the hook 14 is applied against the blade spring 12 and is provided with a portion 17 forming a ramp followed by a top portion 18 which is substantially horizontal in the operating position of the clip.

The clip which has just been described and which travels within the shed with the point 22 of the hook 14 directed towards the reed P operates as follows: substantially at the center of the width of cloth, the weft thread 19 fed by an inserting clip (not shown) is introduced between the facets 16 and 102 respectively of the movable part 3 and of the stationary part 1. The taut portion of the yarn 19 which is still joined to the weft reserve (not shown in the drawings) passes over the hook 14 and plays a contributory role in applying it against the opposite portion 15 of the stationary part, thus serving to enhance the closing action produced on the clip by the spring 12.

Figure 2:
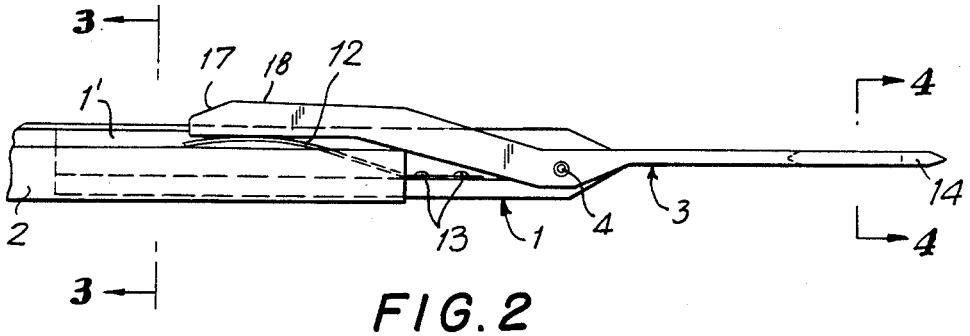
FIG. 2 is a side view of said clip.

When the clip has moved back to a point when the hook 14 passes the corresponding selvedge of the fabric, a cam follower which is stationary with respect to the frame of the loom (but not shown in the drawings) progressively presses against the ramp 17, then bears on the top portion 18 of the movable part 3 and displaces this latter in pivotal motion in opposition to the spring 12 about the pin 4 substantially in a plane at right angles to the plane of the hook 14 and in the direction D indicated by an arrow in FIG. 4. Therefore, the hook 14 moves upwards (FIG. 2) and releases the yarn 19. In order to increase the accuracy of motion of the movable part 3, a portion 3A of said part is guided between two blocks 20, 21 of plastic material which are attached to the clip body 1. The portion 3A is in sliding engagement against the two blocks, though permitting pivoting movement of the movable part 3 with respect to the stationary part 1. The movable part 3 is maintained at one point of its length by the pivot 4, and at another point of its length by the two blocks 20, 21. The result is that said movable part 3, and particularly its hook 14 effect an accurate movement in a vertical plane upon pivotal movement of the movable part, thus ensuring a precise and reliable cooperation of the hook 14 and the stationary active yarn-clamping portion 15 of the body.

By virtue of the fact that the hook is carried by the movable part of the clip and that clamping of the yarn takes place between two inclined facets, it is possible to provide a clip which has a greater degree of rigidity, which therefore ensures more reliable operation, and which is of lighter weight than any clips known up to the present time.

It has been stated earlier that the foregoing description applies to the case in which the point 22 of the hook 14 is directed towards the reed of the loom. The clip is also capable of operating, however, if it is so designed that the point 22 of the hook 14 is directed towards the fell of the cloth. In this case, it may prove an advantage to ensure that the plane of the hook 14 is substantially parallel to the top layer of the shed and that the pivot-pin 4 is inclined correspondingly so as to ensure that the movable part 3 undergoes a displacement in a plane which is oblique with respect to a plane at right angles to the plane of the hook 14.

What is claimed is:

1. An exit clip for insertion of the weft in a shuttleless weaving loom, comprising:

an extended body fixedly connected to a needle for movement therewith;

a movable extended portion pivotably connected at a pivot axis to said body, a hook being at one end of said movable portion, one end of said body being received within said hook at one pivoted position of said hook, a thread of yarn being subject to clamping between facing surfaces of said hook and said one end of said body at said one pivoted position of said hook, said facing surfaces being inclined with respect to a plane of displacement of said movable portion about said pivoting axis, the angle of slope of the clamping facing surfaces being substantially equal to or greater than the limiting angular value which permits maintenance of the clamping grip on the thread formed within the hook, said grip being subject to release by application of external force to said movable portion, and further comprising means for applying said external force.

2. A clip according to claim 1, wherein the plane of displacement of the movable portion is substantially perpendicular to a plane defined by the curvature of the hook.

3. A clip according to claim 1, wherein the plane of displacment of the movable portion is inclined with respect to a plane which is perpendicular to the plane of the hook.

4. A clip according to claim 1 and further comprising a spring biasing said movable portion into said one pivoted position for clamping said thread, a clamped thread bearing on said hook and enhancing the biasing action of said spring.

5. An exit clip for insertion of the weft in a shuttleless weaving loom, comprising:

an extended body fixedly connected to a needle for movement therewith;

a movable extended portion pivotably connected at a pivot axis to said body, a hook being at one end of said movable portion, one end of said body being received within said hook at one pivoted position of said hook, a thread of yarn being subject to clamping between facing surfaces of said hook and said one end of said body at said one pivoted position of said hook, said facing surfaces being inclined with respect to a plane of displacement of said movable portion about said pivoting axis, the inclined clamping facing surface of the body being joined to a straight segment of said body by means of a zone having an angle of slope greater than that of said clamping facing surface.

* * * * *